US011142222B2

(12) United States Patent
Guo et al.

(10) Patent No.: US 11,142,222 B2
(45) Date of Patent: Oct. 12, 2021

(54) VEHICLE END SKELETON STRUCTURE AND RAIL VEHICLE HAVING SAME

(71) Applicant: CRRC QINGDAO SIFANG CO., LTD., Qingdao (CN)

(72) Inventors: Zhanxuan Guo, Qingdao (CN); Haiyang Yu, Qingdao (CN); Honglei Tian, Qingdao (CN); Longxi Liu, Qingdao (CN); Haizhi Yu, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 371 days.

(21) Appl. No.: 16/197,595

(22) Filed: Nov. 21, 2018

(65) Prior Publication Data

US 2019/0084589 A1 Mar. 21, 2019

(30) Foreign Application Priority Data

Sep. 6, 2018 (CN) ..... 201811039695.9

(51) Int. Cl.

| | |
|---|---|
| ***B61D 15/06*** | (2006.01) |
| ***B61D 17/12*** | (2006.01) |
| *B61D 17/06* | (2006.01) |
| *B61G 11/12* | (2006.01) |
| *B61G 11/16* | (2006.01) |

(52) U.S. Cl.

CPC ..... *B61D 15/06* (2013.01); *B61D 17/12* (2013.01); *B61D 17/06* (2013.01); *B61G 11/12* (2013.01); *B61G 11/16* (2013.01)

(58) Field of Classification Search

CPC ..... B61D 15/06; B61D 17/12; B61D 17/06; B61D 17/04; B61D 17/00; B61G 11/16; B61F 1/10

USPC ..... 105/392.5, 402, 410, 421

See application file for complete search history.

(56) References Cited

U.S. PATENT DOCUMENTS 847,500 A * 3/1907 Ostrander ..... B61D 17/12 52/48
914,727 A * 3/1909 Julien et al. ..... B61D 17/06 105/421
5,579,699 A * 12/1996 Dannawi ..... B60R 19/18 105/416

(Continued)

FOREIGN PATENT DOCUMENTS

AU 2005297308 B2 4/2006
CN 103407459 A 11/2013

(Continued)

*Primary Examiner* — Zachary L Kuhfuss
*Assistant Examiner* — Cheng Lin
(74) *Attorney, Agent, or Firm* — Cantor Colburn LLP

(57) ABSTRACT

Provided are a vehicle end skeleton structure and a rail vehicle having the same. The vehicle end skeleton structure comprises: a roof structure, the roof structure being a closed frame structure; and an end energy absorption structure, the upper end of the end energy absorption structure being connected with the roof structure, and the lower end of the end energy absorption structure being connected with a chassis. The technical solution provided in the present invention can solve the problem in the conventional art in which the collision performance of a vehicle end skeleton structure cannot meet current demands.

8 Claims, 4 Drawing Sheets

(56) References Cited

U.S. PATENT DOCUMENTS

| | | | | | |
|---|---|---|---|---|---|
| 6,092,473 | A * | 7/2000 | Altenburg | B61D 17/045 | 105/404 |
| 6,196,135 | B1 * | 3/2001 | Kashima | B61D 15/06 | 105/392.5 |
| 6,263,805 | B1 * | 7/2001 | Taguchi | B61D 15/06 | 105/396 |
| 6,688,237 | B2 * | 2/2004 | Back | B61D 15/06 | 105/392.5 |
| 6,799,794 | B2 * | 10/2004 | Mochidome | B62D 21/152 | 293/143 |
| 6,886,474 | B2 * | 5/2005 | Yamamoto | B61D 15/06 | 105/397 |
| 8,100,237 | B2 * | 1/2012 | Beika | F16F 7/12 | 188/371 |
| 8,707,872 | B2 * | 4/2014 | Kuroda | B61D 15/06 | 105/396 |
| 8,931,418 | B2 * | 1/2015 | Matsuoka | B61D 17/08 | 105/410 |
| 9,090,266 | B2 * | 7/2015 | Nakao | B61D 17/06 | |
| 9,242,656 | B2 * | 1/2016 | Nakao | B61D 17/02 | |
| 10,457,297 | B2 * | 10/2019 | Sato | B61D 15/06 | |
| 2007/0261591 | A1 * | 11/2007 | Bravo | B61C 17/04 | 105/392.5 |

FOREIGN PATENT DOCUMENTS

| | | | | | |
|---|---|---|---|---|---|
| CN | 203485923 | U | | 3/2014 | |
| CN | 106240587 | A | | 12/2016 | |
| JP | 200553306 | A | | 3/2005 | |
| JP | 2017109730 | A | * | 6/2017 | B61D 15/06 |
| WO | 2013083861 | A1 | | 6/2013 | |

* cited by examiner

VEHICLE END SKELETON STRUCTURE AND RAIL VEHICLE HAVING SAME

CROSS REFERENCE TO RELATED APPLICATION

This application is related to and claims the benefit of Chinese Patent Application Number 201811039695.9 filed on Sep. 6, 2018, the contents of which are herein incorporated by reference in their entirety.

TECHNICAL FIELD

The present invention relates to the technical field of rail trains, and in particular to a vehicle end skeleton structure and a rail vehicle having the same.

BACKGROUND

With the high-speed development of the fields of rail transits and the like, the running safety issues have been valued by people increasingly while making travel convenient. Rail transit vehicles such as a subway are usually large in passenger capacity and high in running speed, and once a collision accident happens, serious personnel casualties and property losses will be caused. Recent train rear-ended accidents fully show that train collision accidents cannot be completely avoided even through a series of measures are taken in terms of signal control, scheduling management and programming management. In this case, the performance of a passive safety protection device serving as an ultimate guardian for passenger life and property safety is particularly important.

The statistics show that rail transit vehicles need to absorb a large energy in the collision process, and therefore the collision performance of a vehicle end skeleton structure is an important indicator for quality measurement. With the continuous acceleration of rail transit vehicles, the collision performance of the vehicle end skeleton structure is highly required.

A solution has not been proposed yet for the problem in the conventional art in which the collision performance of a vehicle end skeleton structure cannot meet current demands.

SUMMARY

The present invention provides a vehicle end skeleton structure and a rail vehicle having the same, intended to solve the problem in the conventional art in which the collision performance of a vehicle end skeleton structure cannot meet current demands.

In order to solve the above problem, according to an aspect of the present invention, the present invention provides a vehicle end skeleton structure. The vehicle end skeleton structure comprises: a roof structure, the roof structure being a closed frame structure; and an end energy absorption structure, the upper end of the end energy absorption structure being connected with the roof structure, and the lower end of the end energy absorption structure being connected with a chassis.

Further, the end energy absorption structure comprises: a first energy absorption column, having a first end welded to the roof structure and a second end welded to the chassis; and a second energy absorption column, having a first end welded to the roof structure and a second end welded to a boundary beam of a vehicle.

Further, there are two second energy absorption columns, the two second energy absorption columns being spaced, and the second energy absorption columns being welded to a side wall structure of the vehicle.

Further, there are at least two first energy absorption columns, the at least two first energy absorption columns being located between the two second energy absorption columns, and the at least two first energy absorption columns being spaced.

Further, the number of first energy absorption columns is an even number, the even number of first energy absorption columns being symmetrically disposed along a vehicle width direction of the vehicle.

Further, a first weight-reducing hole is provided on a side, facing the second energy absorption column, of the first energy absorption column.

Further, the cross section of the first energy absorption column is a closed structure, and/or, the cross section of the second energy absorption column is a closed structure.

Further, there are two second energy absorption columns, the two second energy absorption columns being spaced; and there are two first energy absorption columns, the two first energy absorption columns being located between the two second energy absorption columns.

Further, the vehicle end skeleton structure comprises a first anti-expansion plate, wherein one end of the first anti-expansion plate is connected with the first energy absorption column, and the other end of the first anti-expansion plate is connected with the second energy absorption column.

Further, the vehicle end skeleton structure comprises a second anti-expansion plate, two ends of the second anti-expansion plate being connected with one first energy absorption column separately.

Further, an included angle between the second anti-expansion plate and the first anti-expansion plate is an obtuse angle.

Further, there are two first anti-expansion plates, and a connecting line of projections of the two first anti-expansion plates, the two first energy absorption columns, the two second energy absorption columns and the second anti-expansion plate in a plane parallel to the chassis of the vehicle defines a trapezoidal structure.

Further, a connecting line of projections of the two first energy absorption columns and the two second energy absorption columns in a plane parallel to the chassis of the vehicle defines a trapezoidal structure.

Further, the roof structure comprises: a first roof bending beam; and a second roof bending beam, welded to the first roof bending beam to jointly define the closed frame structure.

Further, the roof structure further comprises a roof longitudinal beam, one end of the roof longitudinal beam is connected with the first roof bending beam, and the other end is connected with the second roof bending beam.

Further, there are two roof longitudinal beams, the two roof longitudinal beams are spaced, there are two first energy absorption columns, and first ends of the first energy absorption columns are welded to the roof longitudinal beams in a one-to-one correspondence manner.

According to yet another aspect of the present invention, a rail vehicle is provided. The rail vehicle comprises a vehicle end skeleton structure, wherein the vehicle end skeleton structure is the vehicle end skeleton structure according to any one of the above contents.

According to the technical solution of the present invention, during collision, the upper end of an end energy absorption structure is connected with a roof structure, and the lower end of the end energy absorption structure is connected with a chassis to form a stable whole, thereby preventing the phenomenon of separating components of a rail vehicle under the action of a collision force. In addition, the roof structure is designed as a closed frame structure, thus increasing the stability of the roof structure.

In conclusion, according to the technical solution of the present invention, the technical effects of improving the collision performance of the vehicle end skeleton structure and ensuring the personal safety of a passenger are achieved.

BRIEF DESCRIPTION OF THE DRAWINGS

The accompanying drawings, which constitute a part of this application, are used to provide a further understanding of the present invention, and the exemplary embodiments of the present invention and the description thereof are used to explain the present invention, but do not constitute improper limitations to the present invention. In the drawings.

The drawings include the following reference signs:

80: end energy absorption structure; 81: first energy absorption column; 82: second energy absorption column; 83: first anti-expansion plate; 84: second anti-expansion plate; 811: first weight-reducing hole; 821: second weight-reducing hole; 90: roof structure; 91: first roof bending beam; 92: second roof bending beam; 93: roof longitudinal beam; 94: connecting member; 911: third roof bending beam; 912: fourth roof bending beam; 913: fifth roof bending beam; 931: first roof longitudinal beam; 932: roof longitudinal beam.

DETAILED DESCRIPTION OF THE EMBODIMENTS

The technical solutions in the embodiments of the present invention will be clearly and completely described herein below with the drawings in the embodiments of the present invention. It is apparent that the described embodiments are only part of the embodiments of the present invention, not all of the embodiments. The following description of at least one exemplary embodiment is only illustrative actually, and is not used as any limitation for the present invention and the application or use thereof. On the basis of the embodiments of the present invention, all other embodiments obtained on the premise of no creative work of those of ordinary skill in the art fall within the scope of protection of the present invention.

Figure 1:
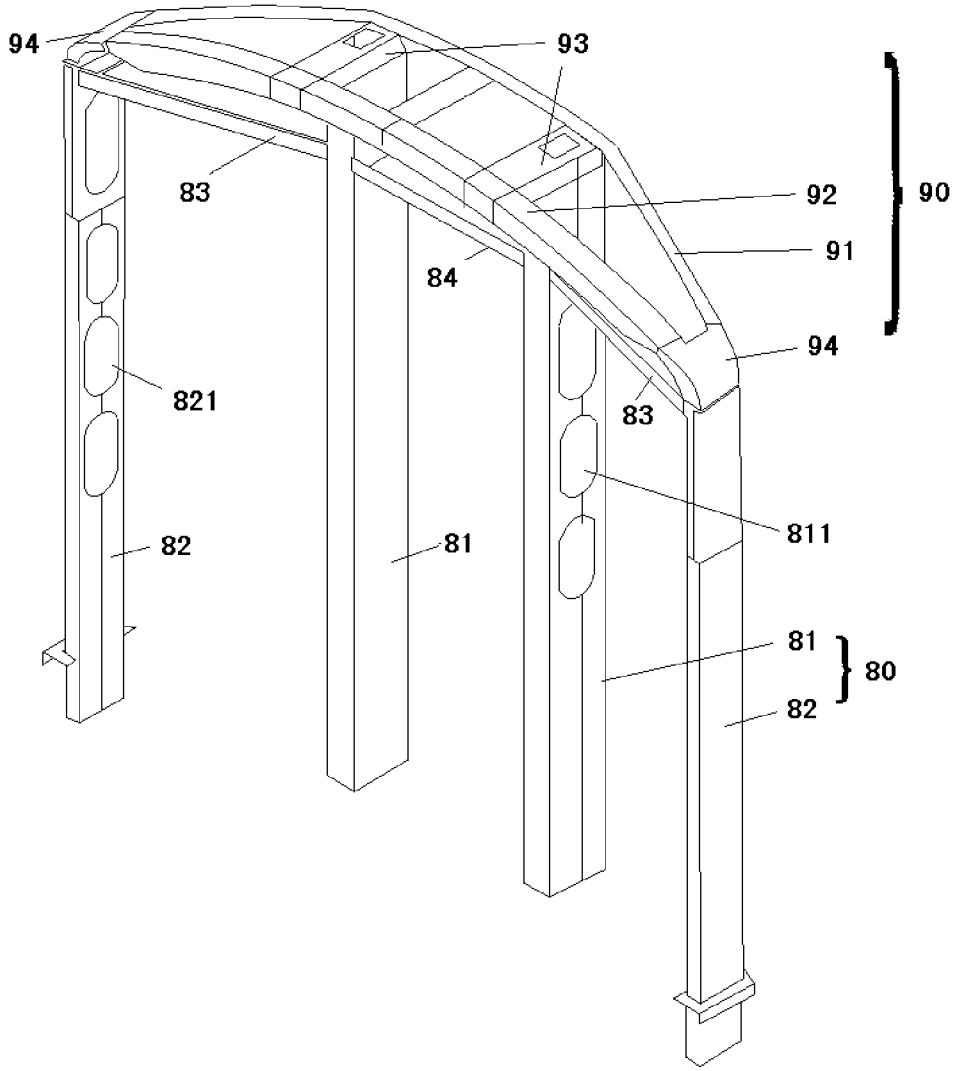
FIG. 1 illustrates a structural schematic diagram of a vehicle end skeleton structure according to the present invention.
Figure 2:
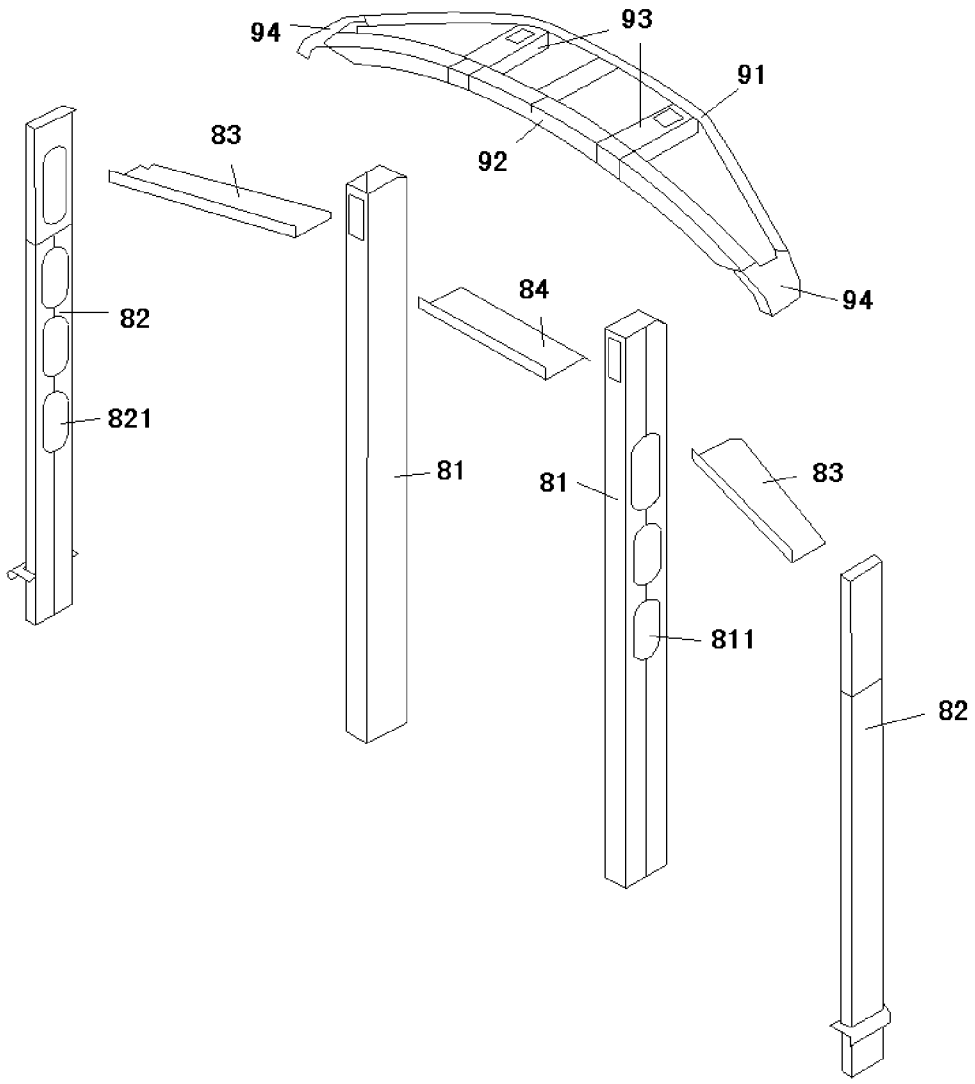
FIG. 2 illustrates an exploded view of the vehicle end skeleton structure in FIG. 1.

As shown in FIG. 1 and FIG. 2, an embodiment of the present invention provides a vehicle end skeleton structure. The vehicle end skeleton structure comprises a roof structure 90 and an end energy absorption structure 80, wherein the roof structure 90 is a closed frame structure, the upper end of the end energy absorption structure 80 is connected with the roof structure 90, and the lower end of the end energy absorption structure 80 is connected with a chassis.

In addition, the vehicle end skeleton structure provided by the embodiment of the present invention further comprises an anti-expansion plate, wherein the anti-expansion plate is used for the internal connection of the end energy absorption structure 80.

Firstly, the end energy absorption structure 80 of the vehicle end skeleton structure is described.

As shown in FIG. 1 and FIG. 2, the end energy absorption structure 80 comprises: a first energy absorption column 81 and a second energy absorption column 82, wherein a first end of the first energy absorption column 81 is welded to the roof structure 90, and a second end of the first energy absorption column 81 is welded to the chassis; and a first end of the second energy absorption column 82 is also welded to the roof structure 90, and a second end of the second energy absorption column 82 is welded to a boundary beam of a vehicle. Such design enables the end energy absorption structure 80 to connect the roof structure 90 and the chassis, and also enables the end energy absorption structure 80 to be connected with the boundary beam of the vehicle, thus improving the integrity and stability of the vehicle end skeleton structure, so that when being collided, the vehicle end skeleton structure will not fall apart to affect the life health of a passenger.

It is to be noted that the first energy absorption column 81 is in welded connection with the roof structure 90 and the chassis, and the second energy absorption column 82 is also in welded connection with the roof structure 90 and the boundary beam. Such connection mode enhances the connecting strength between the roof structure 90, the chassis, the boundary beam, the first energy absorption column 81 and the second energy absorption column 82, that is, enhances the connecting strength between the boundary beam of the vehicle, the chassis, the roof structure 90 and the end energy absorption structure 80, and thus improves the integrity and stability of the vehicle end skeleton structure from the perspective of a connecting mode.

For the second energy absorption column 82, in the embodiment of the present invention, two second energy absorption columns 82 are designed, the two second energy absorption columns 82 are spaced, and the second energy absorption columns 82 are welded to a side wall structure of the vehicle. The above design of increasing the number of the energy absorption columns 82 enhances the connecting strength between the roof structure 90 of the vehicle and the chassis of the vehicle, and the design of welding the second energy absorption columns 82 to the side wall structure of the vehicle improves the integrity of the vehicle end skeleton structure, so that when the vehicle end skeleton structure is collided and extruded, more vehicle components provide an anti-collision support. The design of spacing two energy absorption columns improves the balance of a connecting relationship between the roof structure 90 and the chassis structure, and avoids the distortion and deformation of the vehicle end skeleton structure at a weak part of the connecting relationship caused by the unbalanced connecting relationship between the roof structure 90 and the chassis structure.

For the first energy absorption column 81, in an embodiment of the present invention, there are multiple first energy absorption columns 81, the multiple first energy absorption columns 81 are located between two second energy absorption columns 82, and the multiple first energy absorption columns 81 are spaced. Based on the design description of the second energy absorption column 82, it can be seen that such design enhances the connecting strength between the roof structure 90 and the chassis structure and also improves the balance of a connecting relationship between the roof structure 90 and the chassis structure.

As an optional example, the number of first energy absorption columns 81 may be set as an even number, and the even number of first energy absorption columns 81 are symmetrically disposed along a vehicle width direction of the vehicle. In the example, the position design of the first energy absorption column 81 achieves the technical effect of improving the balance of a connecting relationship between the roof structure 90 and the chassis structure.

As another optional example, as shown in FIG. 1 and FIG. 2, there are two second energy absorption columns 82, the two second energy absorption columns 82 are spaced, there are two first energy absorption columns 81, and the two first energy absorption columns 81 are located between the two second energy absorption columns 82. The example is obtained based on statistic analysis of a great number of experimental data. The number and position of the first energy absorption column 81 in the example and the number and position of the second energy absorption column 82 in the example are stably balanced, that is, a balance between the weight and connecting strength of the end energy absorption structure 80 is achieved, and a balance between the position design and connecting stability of the end energy absorption structure 80 is achieved.

In addition, in the embodiment of the present invention, a first weight-reducing hole 811 is provided on a side, facing the second energy absorption column 82, of the first energy absorption column 81, and a second weight-reducing hole 821 is provided on a side, facing the first energy absorption column 81, of the second energy absorption column 82, so as to reduce the weight of the first energy absorption column 81 and the second energy absorption column 82, thus reducing the weight of the vehicle.

It is to be noted that the first weight-reducing hole 811 provided on the first energy absorption column 81 does not affect the collision performance of the first energy absorption column 81, and the second weight-reducing hole 821 provided on the second energy absorption column 82 does not affect the collision performance of the second energy absorption column 82.

As an optional example, as shown in FIG. 1 and FIG. 2, three first weight-reducing holes 811 are provided on a side, facing the second energy absorption column 82, of the first energy absorption column 81, wherein the first weight-reducing holes 811 are rectangles with smooth corners. Four second weight-reducing holes 821 are provided on a side, facing the first energy absorption column 81, of the second energy absorption column 82, wherein the first weight-reducing holes 811 are rectangles with smooth corners.

In addition, in the embodiment of the present invention, the cross section of the first energy absorption column 81 may be a closed structure, and the cross section of the second energy absorption column 82 may also be closed structure. Such design makes the first energy absorption column 81 and the second energy absorption column 82 unlikely to bend when being collided, thus increasing the collision performance of the first energy absorption column 81 and the second energy absorption column 82.

As an optional example, as shown in FIG. 2, the first energy absorption column 81 and the second energy absorption column 82 may be cylinders of which the cross section is a closed structure, formed by bending sheets.

Secondly, the anti-expansion plate of the vehicle end skeleton structure is described.

Figure 3:
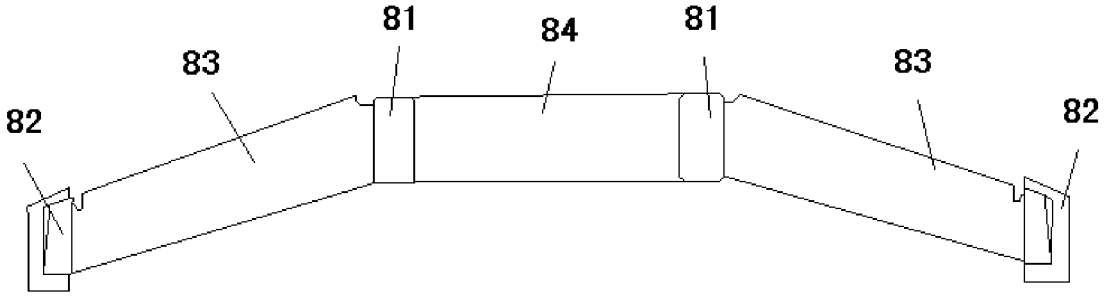
FIG. 3 illustrates a top view of an anti-expansion plate included in the vehicle end skeleton structure in FIG. 1.

As shown in FIG. 1, FIG. 2 and FIG. 3, the anti-expansion plate of the vehicle end skeleton structure mainly comprises a first anti-expansion plate 83 and a second anti-expansion plate 84, wherein one end of the first anti-expansion plate 83 is connected with the first energy absorption column 81, the other end of the first anti-expansion plate 83 is connected with the second energy absorption column 82, and two ends of the second anti-expansion plate 84 are connected with one first energy absorption column 81 separately. Such design enhances the connecting relationship between multiple first energy absorption columns 81 and multiple second energy absorption columns 82, so that the first energy absorption columns 81 and the second energy absorption columns 82 form an associated integrated structure.

As an optional example, as shown in FIG. 3, the first anti-expansion plate 83 is trapezoidal, wherein the top of the first anti-expansion plate 83 is connected with the first energy absorption column 81, and the bottom of the first anti-expansion plate 83 is connected with the second energy absorption column 82. The second anti-expansion plate 84 is rectangular, wherein the short edges of the second anti-expansion plate 84 are connected with two adjacent first energy absorption columns 81.

Based on the above optional example, as shown in FIG. 3, the vehicle end skeleton structure comprises two first anti-expansion plates 83, one second anti-expansion plate 84, two first energy absorption columns 81 and two second energy absorption columns 82. A jointed connecting line of projections of the above components in a plane parallel to the chassis of the vehicle defines a trapezoidal structure. Specifically, the two first anti-expansion plates 83 are connected with the first energy absorption columns 81 and the second energy absorption columns to form waist edges of the trapezoidal structure, the second anti-expansion plate 84 is connected with the two first energy absorption columns 81 to form a top edge of the trapezoidal structure, and naturally, a connecting line of the two second energy absorption columns 82 forms a bottom edge of the trapezoidal structure. Such design makes the horizontal section of the vehicle end of the vehicle have a certain radian. The radian makes the middle of the vehicle end of the vehicle protruded and two sides of the vehicle end depressed, in order that adjacent vehicles turn, thereby preventing the adjacent vehicles from colliding at the edge of the vehicle end when turning. The technical effects of improving the stability of the vehicle end skeleton structure and improving the collision performance of the vehicle are also achieved.

In addition, based on the above optional example, a connecting line of projections of the two first energy absorption columns 81 and the two second energy absorption columns 82 in a plane parallel to the chassis of the vehicle may also define a trapezoidal structure.

Figure 4:
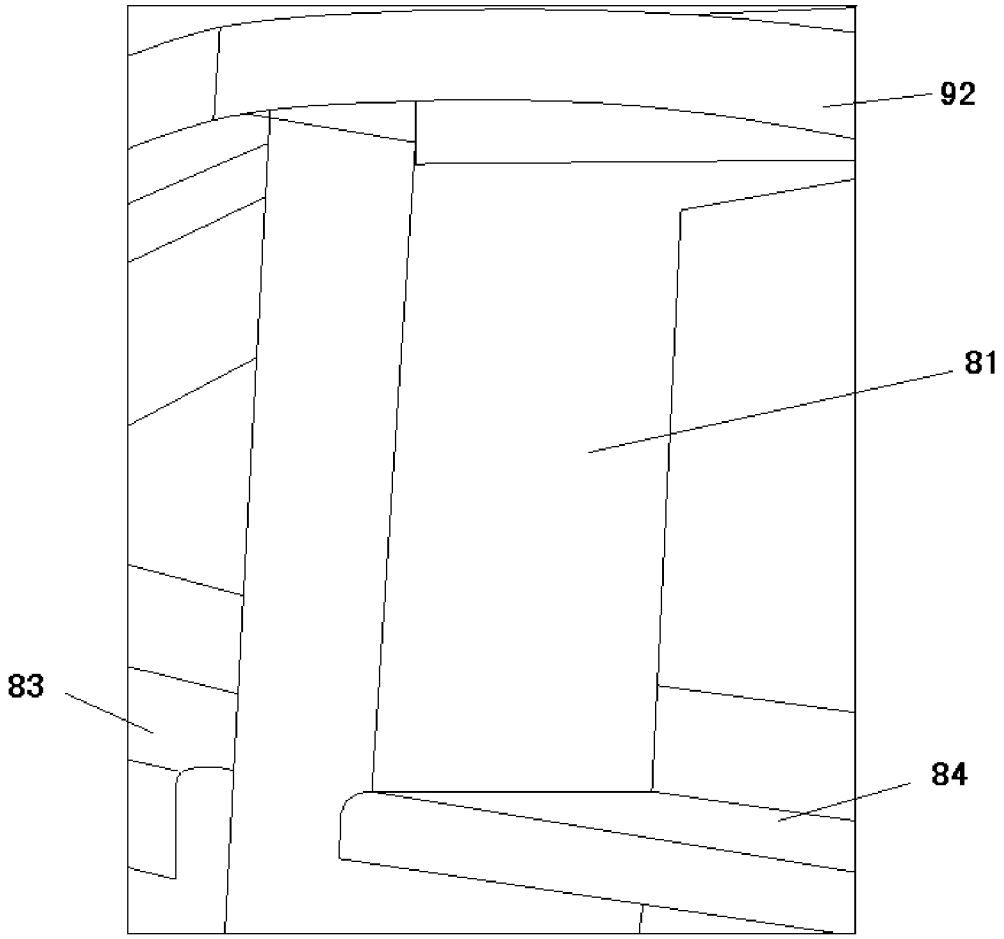
FIG. 4 illustrates a first schematic connecting diagram of the anti-expansion plate included in the vehicle end skeleton structure in FIG. 1.

As an optional example, as shown in FIG. 4, the cross sections of the first anti-expansion plate 83 and the second anti-expansion plate 84 are Z-shaped.

Finally, the roof structure 90 of the vehicle end skeleton structure is described.

Figure 5:
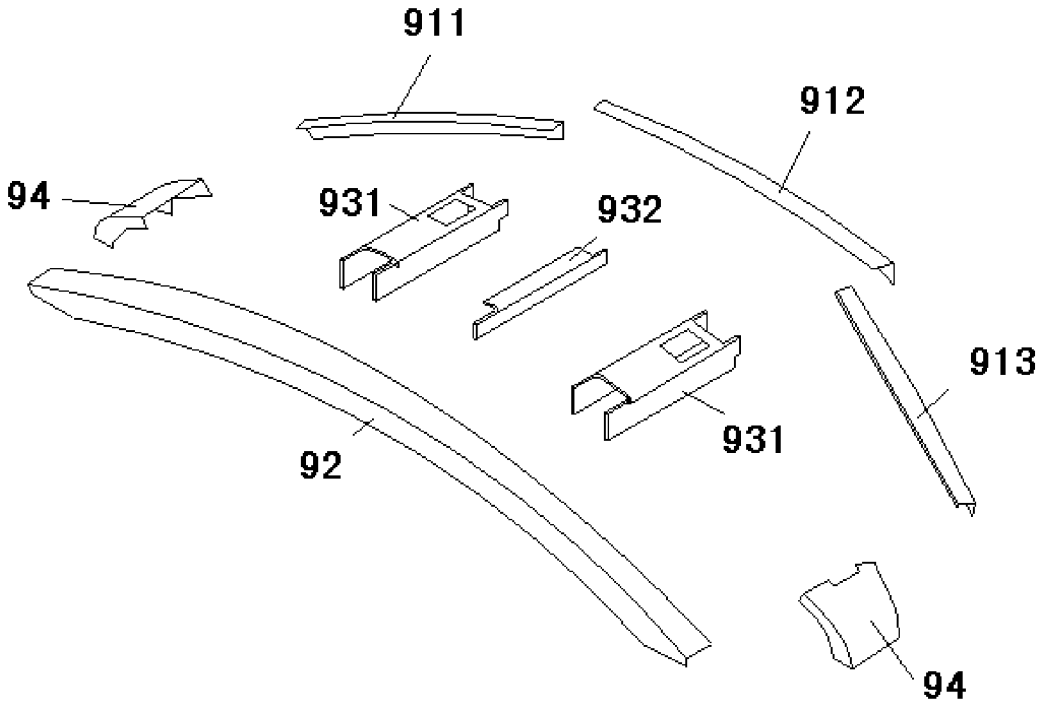
FIG. 5 illustrates an exploded view of a roof structure included in the vehicle end skeleton structure in FIG. 1.

As shown in FIG. 1, FIG. 2 and FIG. 5, the roof structure 90 of the vehicle end skeleton structure mainly comprises: a first roof bending beam 91, a second roof bending beam 92 and a roof longitudinal beam 93, wherein the second roof bending beam 92 is welded to the first roof bending beam 91 to jointly define the closed frame structure, one end of the roof longitudinal beam 93 is connected with the first roof bending beam 91, and the other end of the roof longitudinal beam 93 is connected with the second roof bending beam 92. The roof structure 90 comprises the first roof bending beam 91 and the second roof bending beam 92, which are connected by the roof longitudinal beam 93, so that the stability of the roof structure 90 is improved, and the collision performance is improved.

It is to be noted that in the embodiment of the present invention, the roof structure 90 of the vehicle end skeleton structure may independently form an integrated component, in order for production and mounting.

In the conventional art, the end energy absorption structure 80 of the vehicle is usually connected with the roof bending beam, which makes the roof bending beam deform accordingly when the end energy absorption structure 80 is collided and extruded, thereby seriously affecting the personal safety of a passenger. In the present embodiment, as shown in FIG. 1, the first ends of the first energy absorption columns 81 are welded to the roof longitudinal beams 93 in a one-to-one correspondence manner, thereby avoiding direct connection between the first energy absorption columns 81 and the roof bending beam, and reducing the deformation of the roof structure 90 during the collision.

As an optional example, there are two roof longitudinal beams 93, and the two roof longitudinal beams 93 are spaced; and there are two first energy absorption columns 81, and first ends of the first energy absorption columns 81 are welded to the roof longitudinal beams 93 in a one-to-one correspondence manner.

In addition, for the shape of the roof longitudinal beam 93, as shown in FIG. 5, the roof longitudinal beam 93 comprises a first roof longitudinal beam 931, the cross section is U-shaped, and the side surfaces of two ends extend outward for connecting the first roof bending beam 91 and the second roof bending beam 92. In addition, a through hole is provided on the top surface of the roof longitudinal beam 93 for connecting the first energy absorption columns 81.

In addition, the roof longitudinal beam 93 further comprises another form, as shown in FIG. 5, the roof longitudinal beam 93 comprises a second roof longitudinal beam 932, the cross section is L-shaped, and the side surfaces of two ends extend outward for connecting the first roof bending beam 91 and the second roof bending beam 92.

As another optional example, the roof structure 90 of the vehicle end skeleton structure further comprises a connecting member 94, wherein one end of the connecting member 94 is provided with a first connecting port and a second connecting port, and the other end is provided with a third connecting port. The first connecting port is used for connecting the first roof bending beams 91, the second connecting port is used for connecting the second roof bending beams 92, the third connecting port is connected with the second energy absorption column 82, the longitudinal section of the connecting member 94 has a certain radian, and the horizontal section is Y-shaped.

Based on the above optional example, the connecting member 94 may be a roof corner post.

As another optional example, the first roof bending beam 91 of the vehicle end skeleton structure comprises: a third roof bending beam 911, a fourth roof bending beam 912 and a fifth roof bending beam 913. As shown in FIG. 5, one end of the third roof bending beam 911 is connected with the connecting member 94, and the other end is connected with the roof longitudinal beam 93 and the fourth roof bending beam 912; one end of the fourth roof bending beam 912 is connected with the roof longitudinal beam 93 and the third roof bending beam 911, and the other end is connected with another roof longitudinal beam 93 and the fifth roof bending beam 913; and one end of the fifth roof bending beam 913 is connected with another roof longitudinal beam 93 and fourth roof bending beam 912, and the other end is connected with another connecting member 94.

Another embodiment of the present invention provides a rail vehicle. The rail vehicle comprises a vehicle end skeleton structure in the above embodiment. Therefore, the rail vehicle also has the technical features of the vehicle end skeleton structure, and the rail vehicle can also achieve the technical effect achievable by the vehicle end skeleton structure. That is, the rail vehicle improves the integrity and stability of the vehicle end skeleton structure, so that when being collided, the vehicle end skeleton structure will not fall apart to affect the life health of a passenger.

The above is only the preferred embodiments of the present invention, not intended to limit the present invention. As will occur to those skilled in the art, the present invention is susceptible to various modifications and changes. Any modifications, equivalent replacements, improvements and the like made within the spirit and principle of the present invention shall fall within the scope of protection of the present invention.

It is to be noted that terms used herein only aim to describe specific implementation manners, and are not intended to limit exemplar implementations of this application. Unless otherwise directed by the context, singular forms of terms used herein are intended to include plural forms. Besides, it will be also appreciated that when terms "contain" and/or "include" are used in the description, it is indicated that features, steps, operations, devices, assemblies and/or a combination thereof exist.

Unless otherwise specified, relative arrangements of components and steps elaborated in these embodiments, numeric expressions and numeric values do not limit the scope of the present invention. Furthermore, it should be understood that for ease of descriptions, the size of each part shown in the drawings is not drawn in accordance with an actual proportional relation. Technologies, methods and devices known by those skilled in the related art may not be discussed in detail. However, where appropriate, the technologies, the methods and the devices shall be regarded as part of the authorized description. In all examples shown and discussed herein, any specific values shall be interpreted as only exemplar values instead of limited values. As a result, other examples of the exemplar embodiments may have different values. It is to be noted that similar marks and letters represent similar items in the following drawings. As a result, once a certain item is defined in one drawing, it is unnecessary to further discus the certain item in the subsequent drawings.

In the descriptions of the present invention, it will be appreciated that locative or positional relations indicated by "front, back, up, down, left, and right", "horizontal, vertical, perpendicular, and horizontal", "top and bottom" and other terms are locative or positional relations shown on the basis of the drawings, which are only intended to make it convenient to describe the present invention and to simplify the descriptions without indicating or impliedly indicating that the referring device or element must have a specific location and must be constructed and operated with the specific location, and accordingly it cannot be understood as limitations to the present invention. The nouns of locality "inner and outer" refer to the inner and outer contours of each component.

For ease of description, spatial relative terms such as "over", "above", "on an upper surface" and "upper" may be used herein for describing a spatial position relation between a device or feature and other devices or features shown in the drawings. It will be appreciated that the spatial relative terms aim to contain different orientations in usage or operation besides the orientations of the devices described in the drawings. For example, if the devices in the drawings are inverted, devices described as "above other devices or structures" or "over other devices or structures" will be located as "below other devices or structures" or "under other devices or structures". Thus, an exemplar term "above" may include two orientations namely "above" and "below". The device may be located in other different modes (rotated by 90 degrees or located in other orientations), and spatial relative descriptions used herein are correspondingly explained.

In addition, it is to be noted those terms such as "first" and "second" are used to limit parts, so as only to distinguish the corresponding parts. Unless otherwise stated, the above terms do not have special meanings, and therefore it cannot be interpreted as limitation to the scope of protection of the present invention.

What is claimed is:

1. A vehicle end skeleton structure, comprising:

a roof structure (90), the roof structure (90) being a closed frame structure; and an end energy absorption structure (80), the upper end of the end energy absorption structure (80) being connected with the roof structure (90), and the lower end of the end energy absorption structure (80) being connected with a chassis, the end energy absorption structure (80) comprises a first energy absorption column (81) and a second energy absorption column (82), the first energy absorption column (81) having a first end welded to the roof structure (90) and a second end welded to the chassis; and the second energy absorption column (82) having a first end welded to the roof structure (90) and a second end welded to a boundary beam of a vehicle; there are two second energy absorption columns (82), the two second energy absorption columns (82) being spaced; and there are two first energy absorption columns (81), the two first energy absorption columns (81) being located between the two second energy absorption columns (82);

the vehicle end skeleton structure further comprising a first anti-expansion plate (83) and a second anti-expansion plate (84), wherein one end of the first anti-expansion plate (83) is connected with the first energy absorption column (81), and the other end of the first anti-expansion plate (83) is connected with the second energy absorption column (82), two ends of the second anti-expansion plate (84) being connected with one first energy absorption column (81) separately; an included angle between the second anti-expansion plate (84) and the first anti-expansion plate (83) is an obtuse angle;

the roof structure (90) comprises:

a first roof bending beam (91); and a second roof bending beam (92), welded to the first roof bending beam (91) to jointly define the closed frame structure, the roof structure (90) further comprises a roof longitudinal beam (93), one end of the roof longitudinal beam (93) is connected with the first roof bending beam (91), and the other end is connected with the second roof bending beam (92), there are two roof longitudinal beams (93), the two roof longitudinal beams (93) are spaced, and first ends of the first energy absorption columns (81) are welded to the roof longitudinal beams (93) in a one-to-one correspondence manner, a first weight-reducing hole (811) is provided on a side, facing the second energy absorption column (82), of the first energy absorption column (81).

2. The vehicle end skeleton structure as claimed in claim 1, wherein the second energy absorption columns (82) being welded to a side wall structure of the vehicle.

3. The vehicle end skeleton structure as claimed in claim 2, wherein the number of first energy absorption columns (81) is an even number, the even number of first energy absorption columns (81) being symmetrically disposed along a vehicle width direction of the vehicle.

4. The vehicle end skeleton structure as claimed in claim 1, wherein the cross section of the first energy absorption column (81) is a closed structure, and/or, the cross section of the second energy absorption column (82) is a closed structure.

5. The vehicle end skeleton structure as claimed in claim 1, wherein there are two first anti-expansion plates (83), and a connecting line of projections of the two first anti-expansion plates (83), the two first energy absorption columns (81), the two second energy absorption columns (82) and the second anti-expansion plate (84) in a plane parallel to the chassis of the vehicle defines a trapezoidal structure.

6. The vehicle end skeleton structure as claimed in claim 1, wherein a connecting line of projections of the two first energy absorption columns (81) and the two second energy absorption columns (82) in a plane parallel to the chassis of the vehicle defines a trapezoidal structure.

7. A rail vehicle, comprising a vehicle end skeleton structure, wherein the vehicle end skeleton structure is the vehicle end skeleton structure as claimed in claim 1.

8. The rail vehicle as claimed in claim 7, wherein the vehicle end skeleton structure is the vehicle end skeleton structure as claimed in claim 2.

* * * * *